US006857288B2

(12) United States Patent
Ha et al.

(10) Patent No.: US 6,857,288 B2
(45) Date of Patent: Feb. 22, 2005

(54) HEAT EXCHANGER FOR REFRIGERATOR

(75) Inventors: Sam Chul Ha, Changwon-si (KR); Jong Min Sin, Pusankwangyok-shi (KR); Bong Jun Choi, Changwon-shi (KR); Cheol Hwan Kim, Changwon-shi (KR); Young Hwan Ko, Seoul (KR); Young Jeong, Changwon-shi (KR); Seong Hai Jeong, Changwon-shi (KR); Alexei V Tikhonov, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/475,802

(22) PCT Filed: Feb. 28, 2002

(86) PCT No.: PCT/KR02/00353

§ 371 (c)(1),
(2), (4) Date: Oct. 24, 2003

(87) PCT Pub. No.: WO03/073023

PCT Pub. Date: Sep. 4, 2003

(65) Prior Publication Data

US 2004/0118152 A1 Jun. 24, 2004

(51) Int. Cl.[7] ..... F28F 13/00; F28F 1/00; F25B 39/02

(52) U.S. Cl. ..... 62/526; 62/515; 165/146; 165/172

(58) Field of Search ..... 62/526, 515; 165/146, 165/172, 151, 182

(56) References Cited

U.S. PATENT DOCUMENTS 4,202,182 A 5/1980 Kawashima et al. ..... 62/511
4,715,437 A * 12/1987 Tanaka et al. ..... 165/151

FOREIGN PATENT DOCUMENTS

JP 6249543 9/1994

* cited by examiner

*Primary Examiner*—Chen-Wen Jiang
(74) *Attorney, Agent, or Firm*—Fleshner & Kim, LLP

(57) ABSTRACT

The present invention relates to a heat exchanger in a refrigerator having a simple structure and an improved heat exchange performance. For this, the present invention includes refrigerant tubes (10) having a plurality of straight parts (11) and a plurality of curved parts (12) connected between the straight parts arrange to form one or more columns perpendicular to each other, a plurality of straight plate type fins (20) fitted to the straight parts (11) of the refrigerant tubes (10) by means of a plurality of through holes (21) formed therein to form one or more than columns along a length direction, and one pair of reinforcing plates (30) fitted to the straight parts of the refrigerant tubes on both sides of the fins, wherein ST=D/N, where D denotes a width of the reinforcing plate (30), ST denotes a distance between centers of the refrigerant tube in each column, N denotes a number of the columns of the refrigerant tubes (21).

3 Claims, 15 Drawing Sheets

FIG. 8A

Length of reinforcing plate : 240 mm
Width of reinforcing plate (D) : 60 mm
Fin thickness : 0.2 mm
Diameter of refrigerant tube : 10 mm Distance ($S_T$) : 20 mm
Distance ($S_L$) : 30 mm
Number of refrigerant tube (N) : 2
--> $S_T$ < D/N

| | | | |
|---|---|---|---|
| cmm | m³/ min | 1.376 | 2.80 |
| Tdry | ℃ | -2.25 | |
| Twet | ℃ | -3.38 | |
| ρ | kg / m³ | 1.30103 | |
| μ | kg / m.s | 2.E-05 | |
| Ts | ℃ | -20 | |

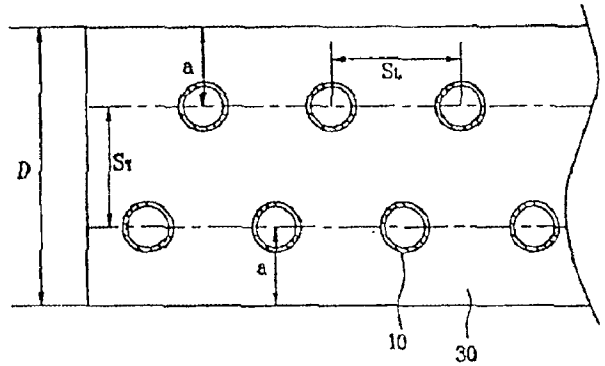

Fin efficiency :
E=0.751

Zhukauskas correlation
for flow across banks of tubes
without fin in external flow $$\Delta P = N_L \chi \left( \frac{\rho V_{max}^2}{2} \right) f$$

(In-Line Tube Bundle) X 3.55

| row | N_Fin | Pitch | AFIN | ATUBE | a | b | n | Dh | Vmax | Re_Dh | f | L | ΔPFIN | | Vmax | Re_D | f | NL | ΔPTUBE |
|---|---|---|---|---|---|---|---|---|---|---|---|---|---|---|---|---|---|---|---|
| | ea | mm | m² | m² | mm | mm | ea | mm | m/s | - | - | mm | mmH₂O | | m/s | - | 0.11 | ea | mmH₂O |
| 1 | 47 | 5.00 | 1.595 | 0.087 | 32.50 | 4.80 | 96 | 8.37 | 1.53 | 973 | 0.066 | 210 | 0.256 | 6 | 1.53 | 1163 | 0.11 | 6 | 0.364 |
| 2 | 23 | 10.00 | 0.391 | 0.044 | 32.50 | 9.81 | 48 | 15.07 | 1.50 | 1716 | 0.037 | 105 | 0.039 | 3 | 1.50 | 1139 | 0.11 | 3 | 0.174 |
| 3 | 11 | 20.00 | 0.187 | 0.045 | 32.50 | 19.82 | 24 | 24.62 | 1.48 | 2776 | 0.023 | 105 | 0.014 | 3 | 1.48 | 1127 | 0.11 | 3 | 0.171 |
| 4 | 5 | 40.00 | 0.113 | 0.060 | 32.50 | 39.83 | 12 | 35.79 | 1.48 | 4015 | 0.016 | 140 | 0.009 | 4 | 1.48 | 1122 | 0.11 | 4 | 0.226 |
| | | | | | | | | | | | | | | 16 | | | | | |
| | 86 | | 2.285 | 0.236 | | | | | Q | 0.491 | | 560 | 0.318 | 25% | | | | | 0.935 |
| | | | 91% | 9% | | | | | | | | 89% | | | | | | | 75% |
| | | | ATOTAL | 2.522 | 112% | | | | | | | | | | | | | | |

DOSH 1.927 0.318
2.245

ΔPS 2.733
ΔPH 1.566
ΔPD 1.167

Pressure loss (mmH₂O) 1.253 80%
1.566 Expected value
DOSH 0.718 Expected value

FIG. 8B

Length of reinforcing plate : 240 mm
Width of reinforcing plate (D) : 60 mm
Fin thickness : 0.2 mm
Diameter of refrigerant tube : 10 mm Distance ($S_T$) : 30 mm
Distance ($S_L$) : 30 mm
Number of refrigerant tube (N) : 2
-> $S_T = D/N$

| | | | |
|---|---|---|---|
| cmm | m³/min | 1.376 | 1.28 |
| Tdry | ℃ | -2.25 | |
| Twet | ℃ | -3.38 | |
| ρ | kg / m³ | 1.30103 | |
| μ | kg / m.s | 2.E-05 | |
| Ts | ℃ | -20 | |

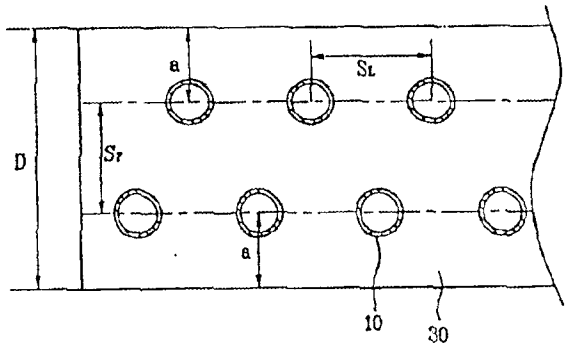

Fin efficiency :
E=0.814

Zhukauskas correlation
for flow across banks of tubes
without fin in external flow $$\Delta P = N_L \chi \left( \frac{\rho V_{max}^2}{2} \right) f$$

(In-Line Tube Bundle) X 0.87

| row | N_Fin | Pitch | AFIN | ATUBE | a | b | n | Dh | Vmax | Re_Dh | f | L | ΔPFIN | | Vmax | Re_D | f | NL | ΔPTUBE |
|---|---|---|---|---|---|---|---|---|---|---|---|---|---|---|---|---|---|---|---|
| | ea | mm | m² | m² | mm | mm | ea | mm | m/s | - | - | mm | mmH2O | | m/s | - | 0.11 | ea | mmH2O |
| 1 | 47 | 5.00 | 1.595 | 0.087 | 32.50 | 4.80 | 96 | 8.37 | 1.53 | 973 | 0.066 | 210 | 0.256 | 6 | 1.53 | 1163 | 0.11 | 6 | 0.090 |
| 2 | 23 | 10.00 | 0.391 | 0.044 | 32.50 | 9.81 | 48 | 15.07 | 1.50 | 1716 | 0.037 | 105 | 0.039 | 3 | 1.50 | 1139 | 0.11 | 3 | 0.043 |
| 3 | 11 | 20.00 | 0.187 | 0.045 | 32.50 | 19.82 | 24 | 24.62 | 1.48 | 2776 | 0.023 | 105 | 0.014 | 3 | 1.48 | 1127 | 0.11 | 3 | 0.042 |
| 4 | 5 | 40.00 | 0.113 | 0.060 | 32.50 | 39.83 | 12 | 35.79 | 1.48 | 4015 | 0.016 | 140 | 0.009 | 4 | 1.48 | 1122 | 0.11 | 4 | 0.056 |
| | | | | | | | | | | | | | | 16 | | | | | |
| | 86 | | 2.285 | 0.236 | | | | | Q | 1.075 | | 560 | 0.318 | 58% | | | | | 0.231 |
| | | | 91% | 9% | | | | | | | | 89% | | | | | | | 42% |
| | | | ATOTAL | 2.522 | 112% | | | | ΔPS | 1.853 | | | | | | | | | |
| | | | | | | | | | ΔPH | 0.686 | | | | | | | | | |
| | | | | | | | | | ΔPD | 1.167 | | | | | | | | | |

DIOS 1 1.927 0.318
2.245

Pressure loss ($mmH_2O$)
0.549 80%
0.686 Expected value
DIOS 0.718 Expected value

FIG. 8C

Length of reinforcing plate : 240 mm
Width of reinforcing plate (D) : 60 mm
Fin thickness : 0.2 mm
Diameter of refrigerant tube : 10 mm Distance ($S_T$) : 40 mm
Distance ($S_L$) : 30 mm
Number of refrigerant tube (N) : 2
-> $S_T > D/N$

| | | | |
|---|---|---|---|
| cmm | m³/ min | 1.376 | 1.20 |
| Tdry | ℃ | -2.25 | |
| Twet | ℃ | -3.38 | |
| ρ | kg / m³ | 1.30103 | |
| μ | kg / m.s | 2.E-05 | |
| Ts | ℃ | -20 | |

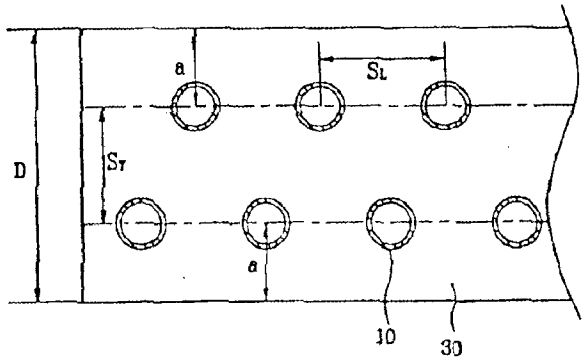

Fin efficiency :
E=0.751

Zhukauskas correlation
for flow across banks of tubes
without fin in external flow $$\Delta P = N_L \chi \left( \frac{\rho V_{max}^2}{2} \right) f$$

(In-Line Tube Bundle) X 0.50

| row | N_Fin | Pitch | AFIN | ATUBE | a | b | n | Dh | Vmax | Re_Dh | f | L | ΔPFIN | | Vmax | Re_D | f | NL | ΔPTUBE |
|---|---|---|---|---|---|---|---|---|---|---|---|---|---|---|---|---|---|---|---|
| | ea | mm | m² | m² | mm | mm | ea | mm | m/s | - | - | mm | mmH₂O | | m/s | - | 0.11 | ea | mmH₂O |
| 1 | 47 | 5.00 | 1.595 | 0.087 | 32.50 | 4.80 | 96 | 8.37 | 1.53 | 973 | 0.066 | 210 | 0.256 | 6 | 1.53 | 1163 | 0.11 | 6 | 0.051 |
| 2 | 23 | 10.00 | 0.391 | 0.044 | 32.50 | 9.81 | 48 | 15.07 | 1.50 | 1716 | 0.037 | 105 | 0.039 | 3 | 1.50 | 1139 | 0.11 | 3 | 0.025 |
| 3 | 11 | 20.00 | 0.187 | 0.045 | 32.50 | 19.82 | 24 | 24.62 | 1.48 | 2776 | 0.023 | 105 | 0.014 | 3 | 1.48 | 1127 | 0.11 | 3 | 0.024 |
| 4 | 5 | 40.00 | 0.113 | 0.060 | 32.50 | 39.83 | 12 | 35.79 | 1.48 | 4015 | 0.016 | 140 | 0.009 | 4 | 1.48 | 1122 | 0.11 | 4 | 0.032 |
| | | | | | | | | | | | | | | 16 | | | | | |
| | 86 | | 2.285 | 0.236 | | | | | Q | 1.147 | | 560 | 0.318 | 71% | | | | | 0.132 |
| | | | 91% | 9% | | | | | | | | 89% | | | | | | | 29% |
| | | | ATOTAL | 2.522 | 112% | | | | ΔPS | 1.729 | | | | | | | | | |
| | | | | | | | | | ΔPH | 0.562 | Pressure | | 0.450 | 80% | | | | | |
| | | | | | | | | | ΔPD | 1.167 | loss | | 0.562 | Expected value | | | | | |
| | | | | | | | | | | | (mmH₂O) | | | | | | | | |
| | | | | | | | | | | | | | 0.718 | Expected value | | | | | |

DIOS : 927 0.318
2.245

FIG. 9A

Length : 240 mm
Width (D) : 60 mm
Fin thickness : 0.2 mm
Diameter : 10 mm

Distance ($S_T$) : 30 mm
Distance ($S_L$) : 20 mm
Number (N) : 2

| | | |
|---|---|---|
| m³/ min | 1.280 | 1.14 |
| ℃ | 5 | |
| ℃ | 3 | |
| kg / m³ | 1.26606 | |
| kg / m.s | 2.E-05 | |
| ℃ | -20 | |

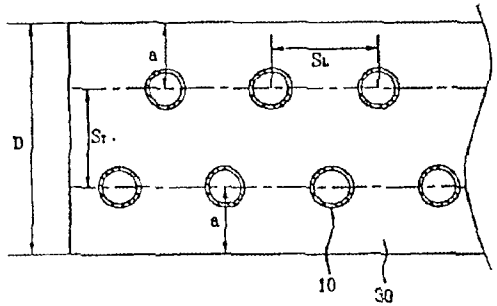

Zhukauskas correlation for flow across banks of tu without fin in external flow $$\Delta P = N_L \chi \left( \frac{\rho V_{max}^2}{2} \right) f$$

(In-Line Tube Bundle) X

| | | |
|---|---|---|
| V | 1.48 | m / s |
| C | 0.270 | - |
| C2 | 0.991 | - |
| m | 0.630 | - |
| k | 0.0243 | W / m℃ |
| Cp | 1007 | J / kg℃ |
| Pr | 0.712 | @ 5℃ |
| Prs | 0.720 | @ -20℃ |

| NuD | h | To | ΔTm | QTUBE | |
|---|---|---|---|---|---|
| - | W/m²℃ | ℃ | ℃ | Kcal/h | |
| 20.6 | 62.6 | -1.7 | 21.5 | 209.2 | Tube |
| | | | | 38% | |

| Pitch | AFIN | ATUBE | a | b | n | Dh | Vmax | Re_Dh | f | L | FIN | Vmax | Re_D | f | NL | UBE |
|---|---|---|---|---|---|---|---|---|---|---|---|---|---|---|---|---|
| mm | m² | m² | mm | mm | ea | mm | m/s | - | - | mm | 2O | m/s | - | 0.10 | ea | 2O |
| 7.06 | 1.014 | 0.106 | 22.00 | 6.86 | 68 | 10.46 | 2.08 | 1575 | 0.041 | 270 | 9 | 2.08 | 1204 | 0.10 | 9 | |
| 16.00 | 0.144 | 0.036 | 22.00 | 15.81 | 30 | 18.40 | 2.04 | 2726 | 0.023 | 90 | 3 | 2.04 | 1185 | 0.10 | 3 | |
| 30.00 | 0.072 | 0.036 | 22.00 | 29.83 | 16 | 25.32 | 2.03 | 3729 | 0.017 | 90 | 3 | 2.03 | 1178 | 0.10 | 3 | |
| | | | | | | | | | | | 15 | | | | | |

| | | | | | | |
|---|---|---|---|---|---|---|
| 1.229 | 0.177 | | Q | 1.125 | 450 | 51% |
| 87% | 13% | | | | 50% | |
| ATOTAL | 1.407 | 63% | ΔPs | 1.767 | | |
| | | | ΔPH | 0.758 | | 87% |

DOS 1.927 W 0.318 R2 245

ΔPD 1.010

DOS 예상치 예상치

| | | |
|---|---|---|
| 8,819 | 193950 | 524 |
| | 129600 | 350 |

| | | | |
|---|---|---|---|
| r1 | 0.0040 | m | |
| r2 | 0.0391 | m | r2c/r1 |
| r2c | 0.0392 | m | 9.797 |
| L | 0.0351 | m | |
| Lc | 0.0393 | m | |
| Ap | 7.9E 06 | m² | |
| k | 238 | W / m℃ | |
| x | 1.4247 | →η | 0.281 |

| Θb | QFIN | |
|---|---|---|
| 18.3 | 339.7 | Fin |
| | 62% | |

Heat exchange Rate (Kcal/h) 548.9

FIG. 9B

Length : 240 mm
Width (D) : 60 mm
Fin thickness : 0.2 mm
Diameter : 10 mm

Distance ($S_T$) : 30 mm
Distance ($S_L$) : 30 mm
Number (N) : 2

| | | |
|---|---|---|
| m³/ min | 1.280 | 1.24 |
| ℃ | 5 | |
| ℃ | 3 | |
| kg / m³ | 1.26606 | |
| kg / m.s | 2.E-05 | |
| ℃ | 20 | |

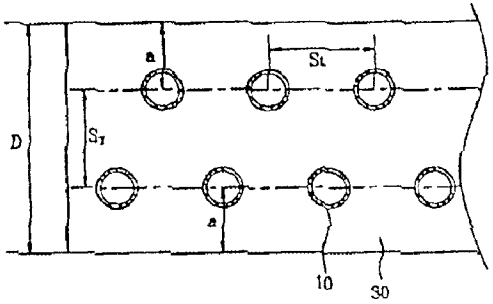

Zhukauskas correlation for flow across banks of tu without fin in external flow $$\Delta P = N_L \chi \left( \frac{\rho V_{max}^2}{2} \right) f$$

(In-Line Tube Bundle) X

| | | |
|---|---|---|
| V | 1.48 | m / s |
| C | 0.270 | - |
| C2 | 0.991 | - |
| m | 0.630 | - |
| k | 0.0243 | W / m℃ |
| Cp | 1007 | J / kg℃ |
| Pr | 0.712 | @ 5℃ |
| Prs | 0.720 | @ -20℃ |

| NuD | h | Tq | ΔTm | QTUBE | |
|---|---|---|---|---|---|
| - | W/m²℃ | ℃ | ℃ | Kcal/h | |
| 20.6 | 62.6 | -3.5 | 20.4 | 199.2 | Tube |
| | | | | 35% | |

| Pitch | AFIN | ATUBE | a | b | n | Dh | Vmax | Re_Dh | f | L | FIN | Vmax | Re_D | f | NL | UBE |
|---|---|---|---|---|---|---|---|---|---|---|---|---|---|---|---|---|
| mm | m² | m² | mm | mm | ea | mm | m/s | - | - | mm | 2O | m/s | - | 0.10 | ea | 2O |
| 7.06 | 1.014 | 0.106 | 22.00 | 6.86 | 68 | 10.46 | 2.08 | 1575 | 0.041 | 270 | 9 | 2.08 | 1204 | 0.10 | 9 | |
| 16.00 | 0.144 | 0.036 | 22.00 | 15.81 | 30 | 18.40 | 2.04 | 2726 | 0.023 | 90 | 3 | 2.04 | 1185 | 0.10 | 3 | |
| 30.00 | 0.072 | 0.036 | 22.00 | 29.83 | 16 | 25.32 | 2.03 | 3729 | 0.017 | 90 | 3 | 2.03 | 1178 | 0.10 | 3 | |
| | | | | | | | | | | | 15 | | | | | |

| | | | | | |
|---|---|---|---|---|---|
| 1.229 | 0.177 | | Q | 1.035 | 450 43% |
| 87% | 13% | | | | 50% |
| ATOTAL | 1.407 | 63% | ΔPs | 1.919 | |
| | | | ΔPH | 0.909 | 87% |
| DIOS | 0.927 | 0.318 | ΔPD | 0.010 | 예상치 |
| | | 2.246 | | | |
| | | | DIOS | 예상치 | |
| 8,819 | 193950 | 524 | | | |
| | 129600 | 350 | | | |

| | | | |
|---|---|---|---|
| r1 | 0.0040 | m | |
| r2 | 0.0339 | m | r2c/r1 |
| r2c | 0.0340 | m | 8.488 |
| L | 0.0299 | m | |
| Lc | 0.0341 | m | |
| Ap | 6.8E-06 | m² | |
| k | 238 | W / m℃ | |
| x | 1.2348 | →η | 0.335 |

| Θb | QFIN | |
|---|---|---|
| 16.5 | 365.0 | Fin |
| | 65% | |
| | 564.2 | |

Heat exchange Rate (Kcal/h)

FIG. 9C

Length : 240 mm
Width (D) : 60 mm
Fin thickness : 0.2 mm
Diameter : 10 mm

Distance ($S_T$) : 30 mm
Distance ($S_L$) : 40 mm
Number (N) : 2

| | | |
|---|---|---|
| m³/ min | 1.280 | 1.59 |
| ℃ | 5 | |
| ℃ | 3 | |
| kg / m³ | 1.26606 | |
| kg / m.s | 2.E-05 | |
| [illegible] | 0 | -20 |

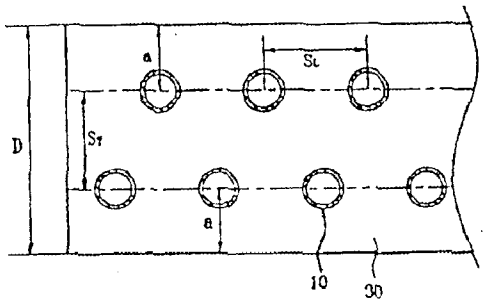

Zhukauskas correlation
for flow across banks of tu
without fin in external flow $$\Delta P = N_L \chi \left( \frac{\rho V_{max}^2}{2} \right) f$$

(In-Line Tube Bundle) X

| | | |
|---|---|---|
| V | 1.48 | m / s |
| C | 0.270 | - |
| C2 | 0.991 | - |
| m | 0.630 | - |
| k | 0.0243 | W / m℃ |
| Cp | 1007 | J / kg℃ |
| Pr | 0.712 | @ 5℃ |
| Prs | 0.720 | @ -20℃ |

| $N_{UD}$ | h | $T_o$ | $\Delta T_m$ | $Q_{TUBE}$ | |
|---|---|---|---|---|---|
| - | W/m²℃ | ℃ | ℃ | Kcal/h | |
| 20.6 | 62.6 | -6.6 | 18.6 | 181.1 | Tube |
| | | | | 33% | |

| Pitch | $A_{FIN}$ | $A_{TUBE}$ | a | b | n | Dh | Vmax | Re_Dh | f | L | FIN | Vmax | Re_D | f | $N_L$ | UBE |
|---|---|---|---|---|---|---|---|---|---|---|---|---|---|---|---|---|
| mm | m² | m² | mm | mm | ea | mm | m/s | - | - | mm | 2O | m/s | - | 0.10 | ea | 2O |
| 7.06 | 1.014 | 0.106 | 22.00 | 6.86 | 68 | 10.46 | 2.08 | 1575 | 0.041 | 270 | 9 | 2.08 | 1204 | 0.10 | 9 | |
| 16.00 | 0.144 | 0.036 | 22.00 | 15.81 | 30 | 18.40 | 2.04 | 2726 | 0.023 | 90 | 3 | 2.04 | 1185 | 0.10 | 3 | |
| 30.00 | 0.072 | 0.036 | 22.00 | 29.83 | 16 | 25.32 | 2.03 | 3729 | 0.017 | 90 | 3 | 2.03 | 1178 | 0.10 | 3 | |
| | | | | | | | | | | | 15 | | | | | |

| $\Theta_b$ | $Q_{FIN}$ | |
|---|---|---|
| 13.4 | 373.0 | Fi |
| | 67% | |
| | 554.1 | |

Heat exchange Rate (Kcal/h)

| | | | | | | |
|---|---|---|---|---|---|---|
| 1.229 | 0.177 | | Q | 0.803 | 450 | 31% |
| 87% | 13% | | | | 50% | |
| ATOTAL | 1.407 | 63% | ΔPS | 2.284 | | |
| DIOS | 0.277 | 0.381 | ΔPH | 1.275 | | 87% |
| | | 2.245 | APD | 1.010 | | 예상치 |
| | | | DIOS | | 예상치 | |
| 8,819 | 193950 | 624 | | | | |
| | 129600 | 350 | | | | |

| | | | |
|---|---|---|---|
| r1 | 0.0040 | m | |
| r2 | 0.0276 | m | r2c/r1 |
| r2c | 0.0277 | m | 6.935 |
| L | 0.0236 | m | |
| Lc | 0.0278 | m | |
| Ap | 5.6E-06 | m² | |
| k | 238 | W / m℃ | |
| x | 1.0095 | →η | 0.421 |

HEAT EXCHANGER FOR REFRIGERATOR

TECHNICAL FIELD

The present invention relates to a heat exchanger for a refrigerator, and more particularly, to a heat exchanger applied to a refrigerator for producing cold air to be supplied to a refrigerating chamber and a freezing chamber.

BACKGROUND ART

In addition to the refrigerating chamber and the freezing chamber separated from each other, the refrigerator is provided with a so called machine room in a lower part thereof, and air passages in a rear part of the refrigerating chamber and the freezing chamber connected thereto. The heat exchanger (evaporator) is fitted on the air passages, together with a fan, for supplying cold air to the refrigerating chamber and the freezing chamber in association with a compressor and condensers in the machine room. That is, high temperature and high pressure refrigerant supplied through the compressor and the condensers is evaporated in the heat exchanger, to cool down environmental air by a latent heat of the vaporization. The fan circulates air throughout the Refrigerator for supplying the air cooled down through the heat exchanger to the refrigerating chamber and the freezing chamber, continuously.

A related art heat exchanger for the refrigerator is illustrated in FIGS. 1 and 2, referring to which the related art heat exchanger will be explained.

As shown, the heat exchanger is provided with refrigerating tube 1 for flow of the refrigerant, and a plurality of fins 1 fitted at fixed intervals parallel to one another along the refrigerating tube.

In more detail, the refrigerating tube 1 is coupled with the fins 2 while one line of the refrigerating tube 1 forms one column in the heat exchanger. FIG. 2 illustrates two columns formed by two lines of refrigerating tube 1.

As shown in FIG. 2, the fin 2, actually in a form of small plate, has through holes 2*a* for coupling with the refrigerating tube 1. That is, the related art heat exchanger has discrete fins 2, to form discrete heat exchange surfaces along a length of the heat exchanger.

Moreover, during operation, much moisture in the air in the refrigerator is frosted on surfaces of the heat exchanger owing to a subzero environmental temperature, to impede circulation of the air. Therefore, in general, there is defroster 3 provided to the heat exchanger for defrosting, for which separate defrosting process is conducted.

The heat exchanger stands upright in the air flow passage, and the air in the refrigerator is introduced into the heat exchanger from below and exits from a top of the heat exchanger as shown in arrows.

Currently, despite the foregoing heat exchangers are applied to most of the refrigerators, the heat exchangers have the following structural problems, actually.

For an example, the fins 2 are fitted to the refrigerating tube 1 one by one because the fins 2 are discrete and have individual shape characteristics. The fins 2 are fitted along the refrigerating tube at intervals different from each other between an upper part and a lower part thereof. That is, as a flow resistance caused by the growth of the frost deteriorates a heat exchanger performance, the fins 2 are fitted in the lower part, an air inlet side, that has more frosting at intervals greater than the upper part.

Water from the defrosting stays at lower edges 2*b* of the fins 2 in a form of a relatively big water drop by surface tension, and acts as nuclei of frost growth in a subsequent operation of the refrigerator (cooling process), again. Therefore, in order to suppress the growth of the frost, as shown, it is required that the defroster 3 is arranged so as to be in contact with every lower edge 2*a*.

At the end, the use of the discrete type of fins makes a structure of the related art heat exchanger complicate actually, that makes assembly difficult. Moreover, it is preferable that the heat exchanger is small sized and has a high efficiency because the heat exchanger is placed in the comparatively small air flow passage. However, the foregoing structural problem impedes design change of the related art heat exchanger, for optimization of the heat exchanger.

DISCLOSURE OF INVENTION

The object of the present invention, devised for solving the foregoing problems, lies on providing a heat exchanger for a refrigerator, which has a simple structure, and is easy to fabricate.

Another object of the present invention is to provide a heat exchanger for a refrigerator having an improved heat exchange performance.

The present invention can be achieved by providing a heat exchanger for a refrigerator including one, or more than one perpendicular columns of refrigerating tubes each including a plurality of straight parts, and a plurality of curved parts connecting the straight parts, a plurality of straight plate type fins each having a plurality of through holes formed therein on one or more than one column along a length direction for coupling with the straight parts of the refrigerating tubes, and one pair of reinforcing plates coupled with the straight parts of the refrigerating tube at opposite sides of the fins, wherein $S_T$=D/N, where 'D' denotes a width of the reinforcing plate, $S_T$ denotes a distance between centers of the refrigerant tube on the same column, and N denotes a number of columns of the refrigerating tube.

It is preferable that a=$S_T$/2, where 'a' denotes a distance from a center of the refrigerant tube on an outermost column to a side edge of the reinforcing plate.

It is preferable that $S_T/S_L$=1, where $S_L$ denotes a distance between centers of straight parts of the refrigerant tube on the same column.

Thus, the present invention simplifies a structure and assembly process of the heat exchanger, and improves a heat exchange performance. Accordingly, the heat exchanger of the present invention is optimized to the refrigerator.

BRIEF DESCRIPTION OF DRAWINGS

It is to be understood that both the foregoing general description and the following detailed description are exemplary and explanatory and are intended to provide further explanation of the invention as claimed.

The accompanying drawings, which are included to provide a further understanding of the invention and are incorporated in and constitute a part of this specification, illustrate embodiments of the invention and together with the description serve to explain the principles of the invention:

In the drawings:

FIG. 1 illustrates a front view of a related art heat exchanger for a refrigerator;

FIG. 2 illustrates a side sectional view across a line I—I in FIG. 1;

FIG. 3A illustrates a front view of a heat exchanger for a refrigerator in accordance with a preferred embodiment of the present invention;

FIG. 3B illustrates a side sectional view across a line II—II in FIG. 3A;

FIG. 4A illustrates a front view of a heat exchanger for a refrigerator having a variation of a refrigerating tube arrangement in accordance with a preferred embodiment of the present invention;

FIG. 4B illustrates a side sectional view across a line III—III in FIG. 4A;

FIG. 5 illustrates a graph showing amounts of remained defrosted water per a unit area of fin of the related art and the present invention;

FIG. 6 illustrates a graph showing operation time period vs. pressure loss of the related art and the present invention;

FIG. 7 illustrates a side view showing a geometrical relation of a reinforcing plate and refrigerating tube in the heat exchanger of the present invention;

FIGS. 8A–8C illustrate test results of column pitch variation of refrigerating tube lines; and, FIGS. 9A–9C illustrate test results of pitch variation of straight parts of the same refrigerating tube line.

BEST MODE FOR CARRYING OUT THE INVENTION

Reference will now be made in detail to the preferred embodiments of the present invention, examples of which are illustrated in the accompanying drawings. In explanation of embodiments the present invention, identical parts will be given the same name and symbols, and iterative explanation of which will be omitted.

Figure 1:
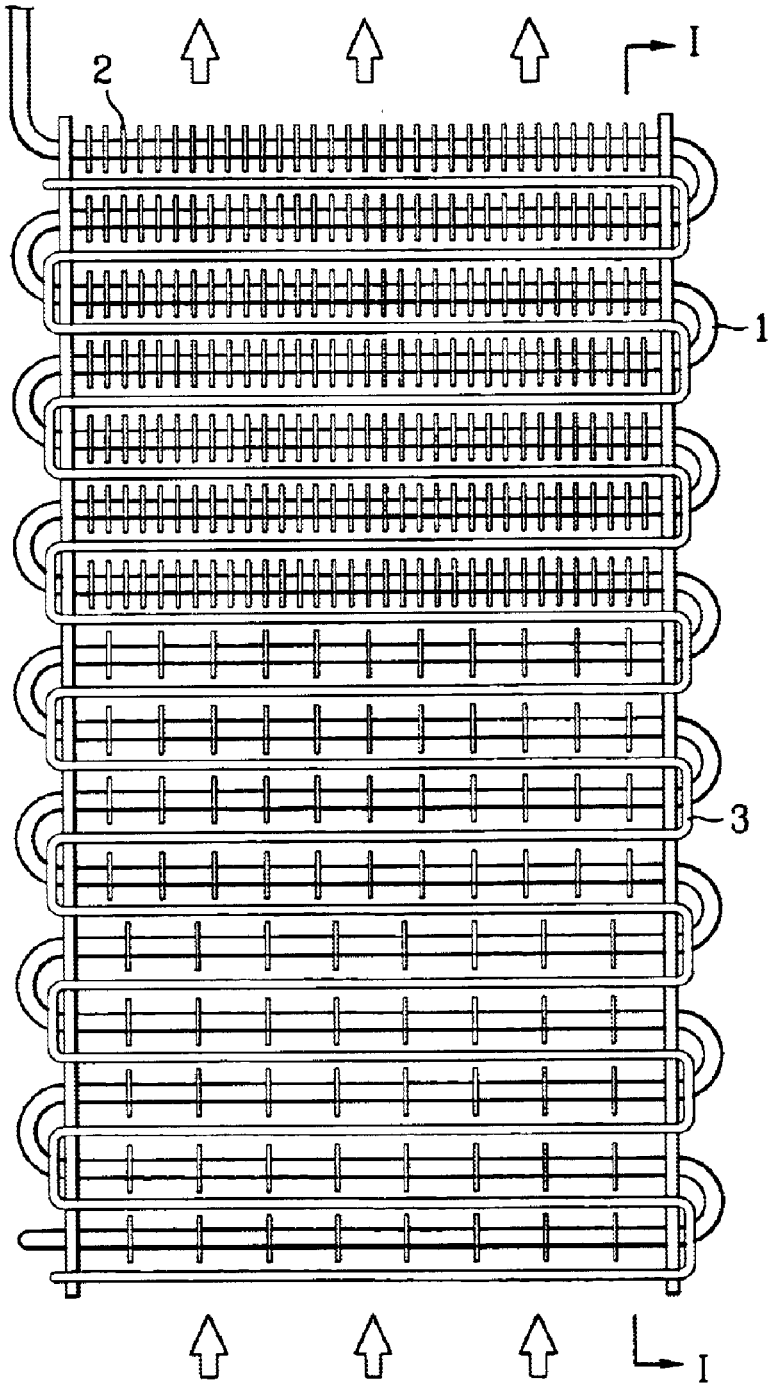
FIG. 1 Prior Art
Figure 2:
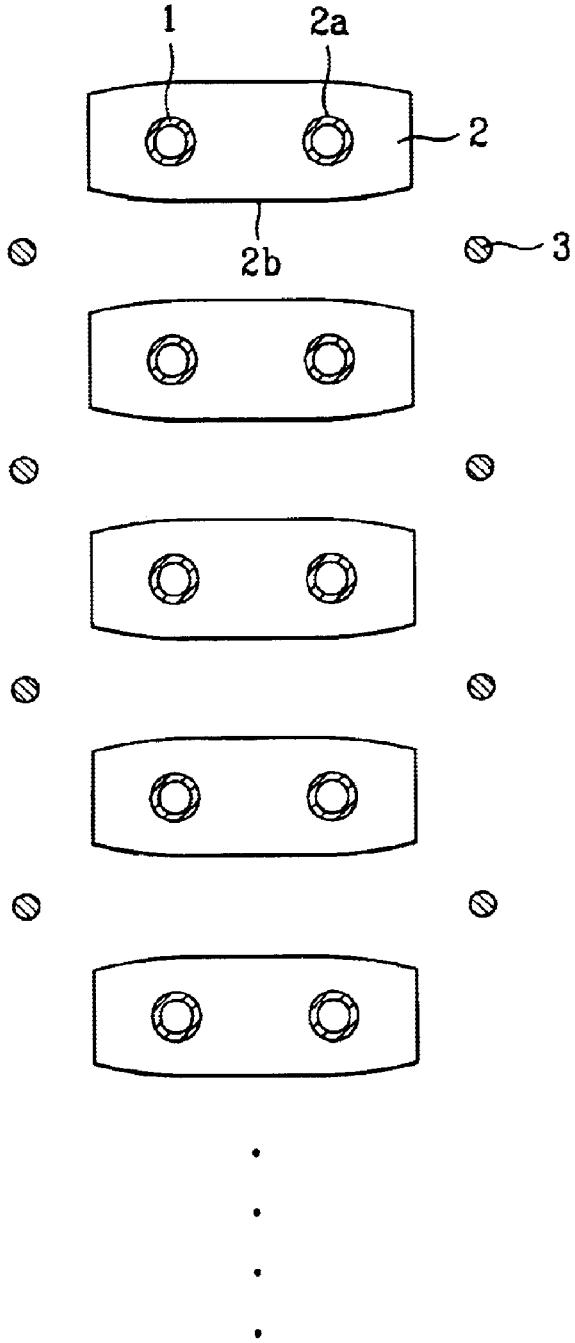
FIG. 2 Prior Art
Figure 3A:
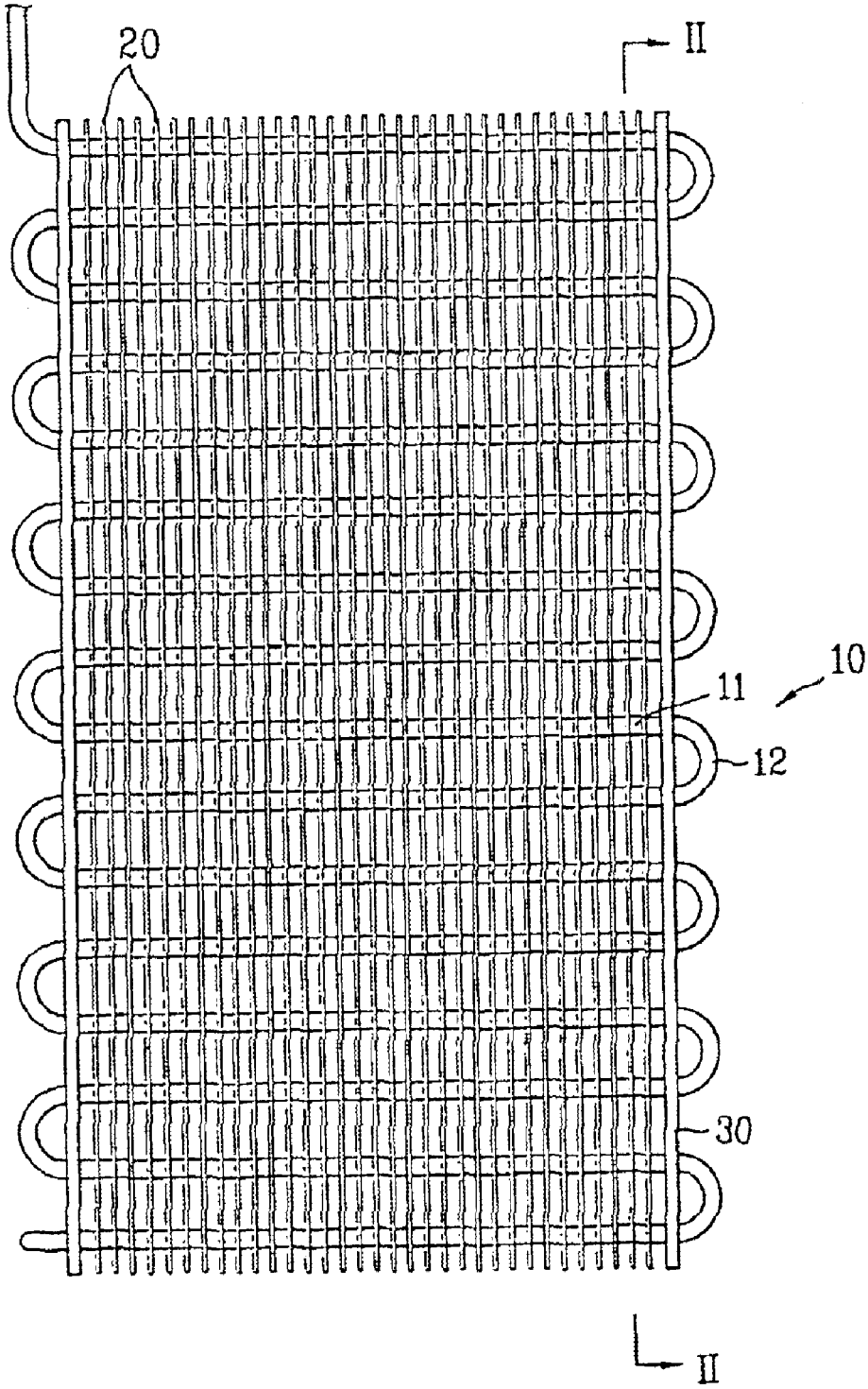
Figure 3B:
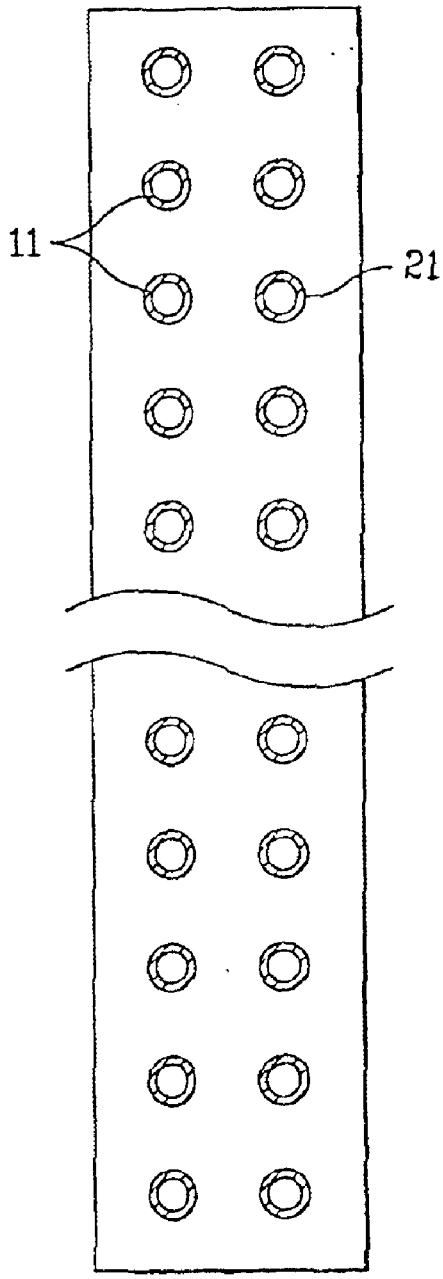

FIG. 3A illustrates a front view of a heat exchanger for a refrigerator in accordance with a preferred embodiment of the present invention, and FIG. 3B illustrates a side sectional view across a line II—II in FIG. 3B, referring to which a structure of the present invention will be explained, in detail.

In overall, the heat exchanger includes one, or more than one refrigerating tube 10 for forming a flow passage of refrigerant from a condenser, and a plurality of fins 20 fitted to the refrigerant tube 10. The heat exchanger has one pair of parallel reinforcing plates 30 on both sides of the fins 20 fitted to the heat exchanger.

Figure 4A:
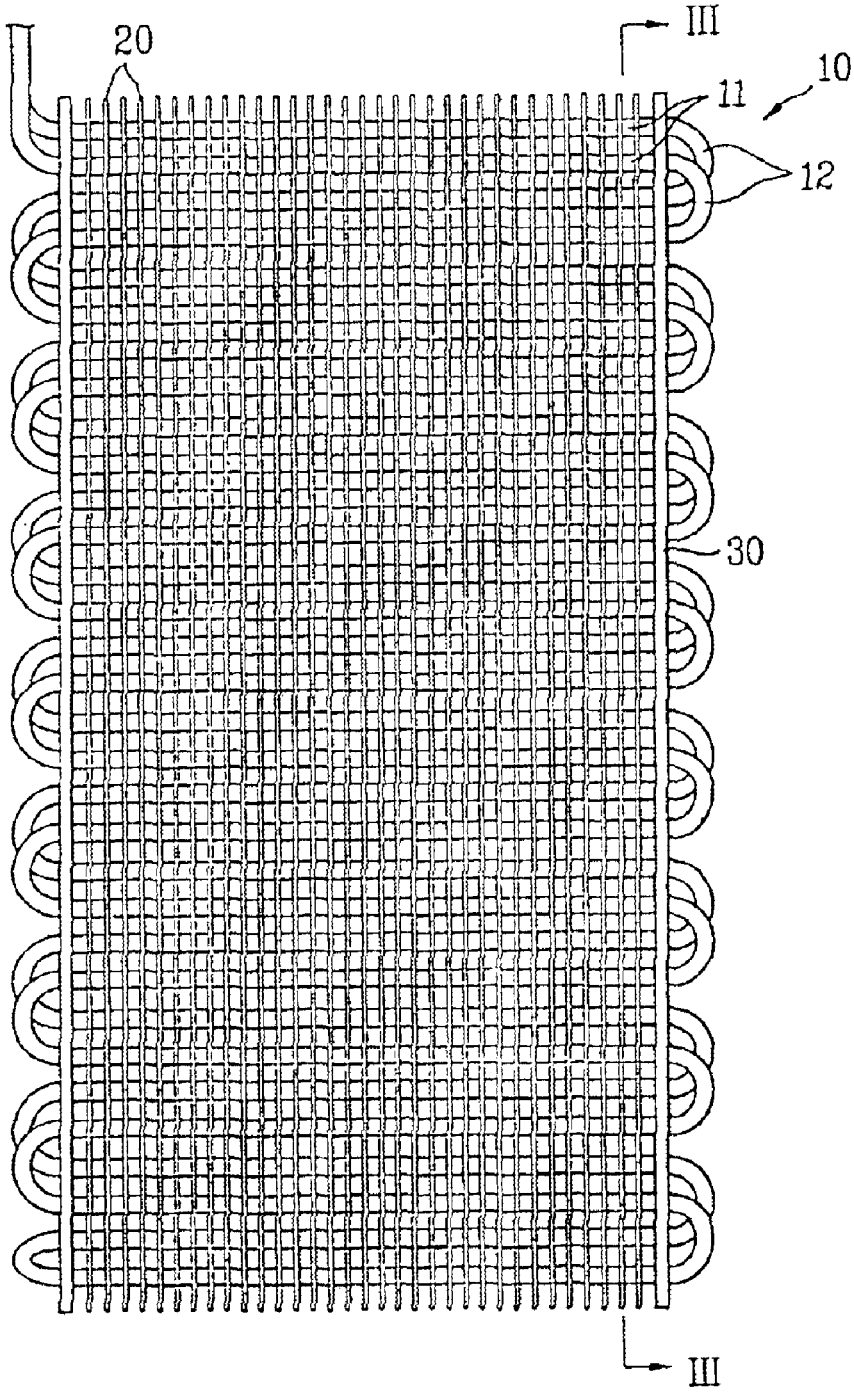
Figure 4B:
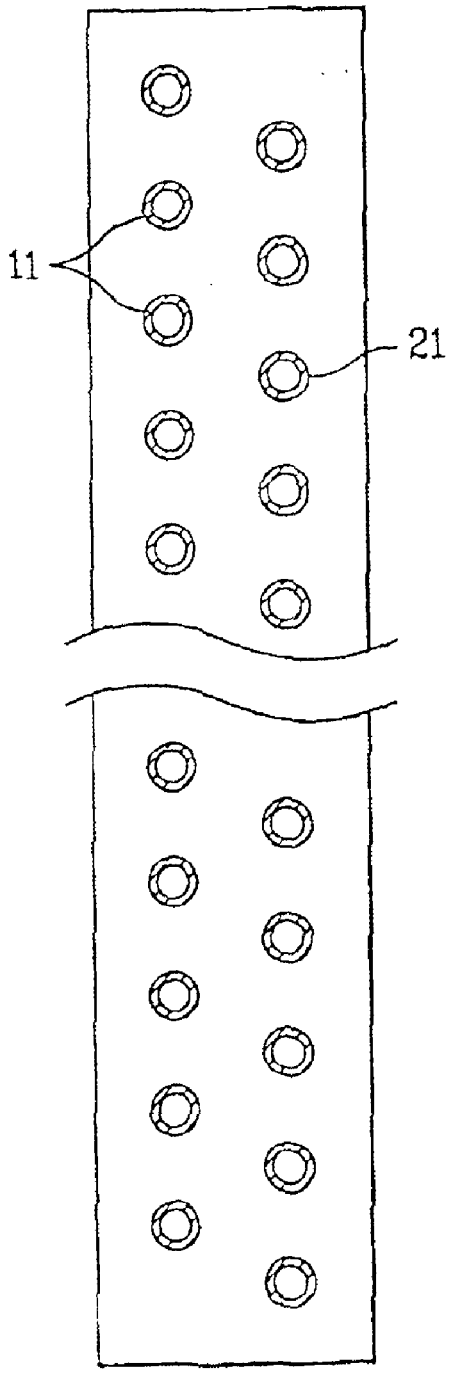

A line of the refrigerating tube 10 includes a plurality of straight parts 11 at fixed intervals, and a plurality of curved parts 12 connecting the straight parts 11. The refrigerating tube 10, more specifically, the straight parts 11, are substantially arranged vertical to an air flow direction, and as shown in FIG. 3B, one line of the refrigerating tube 10 forms a column in a length direction of the heat exchanger. As shown in FIGS. 3A and 3B, straight parts 11 of other line of the heat exchanger tube in other column may be aligned to each other in a horizontal direction. However, as shown in FIGS. 4A and 4B, for improved performance of the heat exchanger, it is preferable that the straight parts 11 are perpendicular to each other, together with fin pass through holes 21. The perpendicular arrangement prevents grown frost from bridging between adjacent two refrigerant tubes 10, that prevents an increase of a flow resistance.

The fin 20 is a flat straight plate with a fixed length, and has a plurality of through holes 21 on one or more columns in a length direction of the fin 20 for coupling with the refrigerant tube 10. In more detail, as shown in FIGS. 3B and 4*b*, the fin 20 of the present invention is coupled with the straight part 11 of the refrigerant tube 10 along a length direction of the straight part 11 at fixed intervals parallel to each other, to extend such that the straight parts 11 on the same column are connected in succession. Accordingly, the water (hereafter call as 'defrosted water') formed at the refrigerant tube 10 and the fins 20 during the defrosting is discharged along the fins 10 from the upper part to the lower part of the heat exchanger, smoothly. Moreover, the straight fin 20 of the present invention applied thereto permits to reduce the defrosted water remained by surface tension because the straight fin 20 has fewer number of the lower edges compared to the discrete fin.

Figure 5:
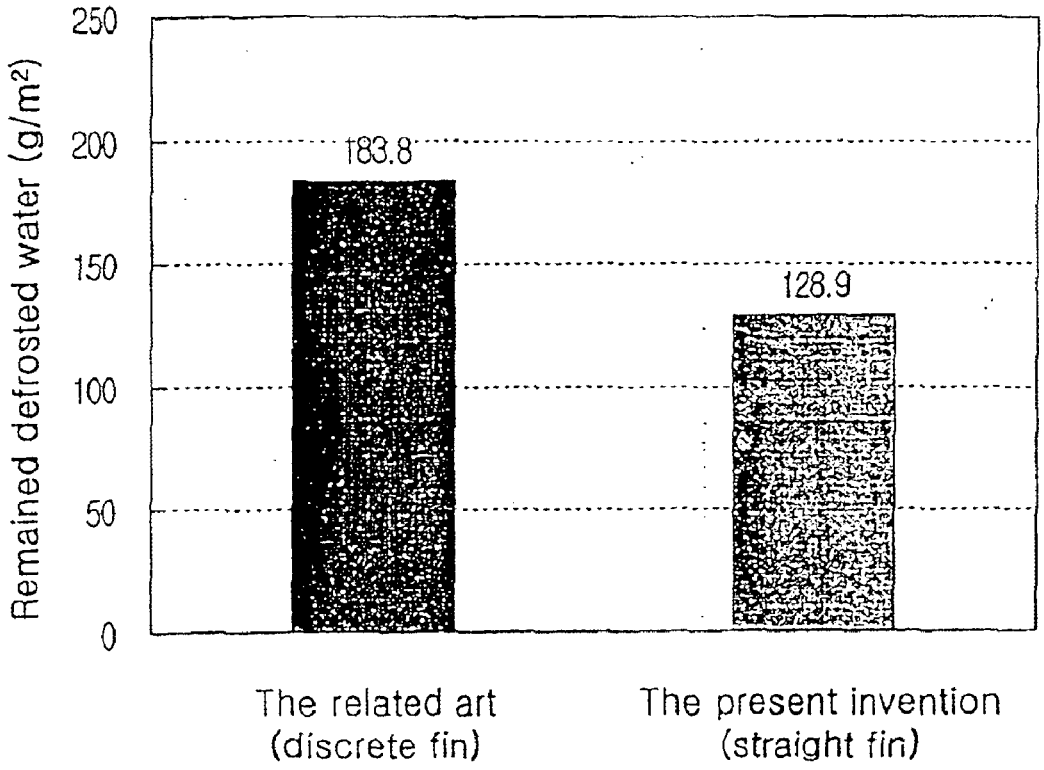

Such a tendency can be verified by an actual test. FIG. 5 illustrates a graph showing an amount of remained defrosted water per a unit area of fin of the related art or the present invention, wherein the discrete fin (the related art) and the straight fin (the present invention) are compared. The amounts of remained defrosted water are measured after a certain time period is passed from the starting of the defrosting. As shown in FIG. 5, while the straight fin has 128.0 $g/m^2$ of remained defrosted water, the discrete fin has 183.8 $g/m^2$ of remained defrosted water, greater than the straight fin. In more detail, the remained defrosted water of the straight fin is merely 70% of the discrete fin.

Figure 6:
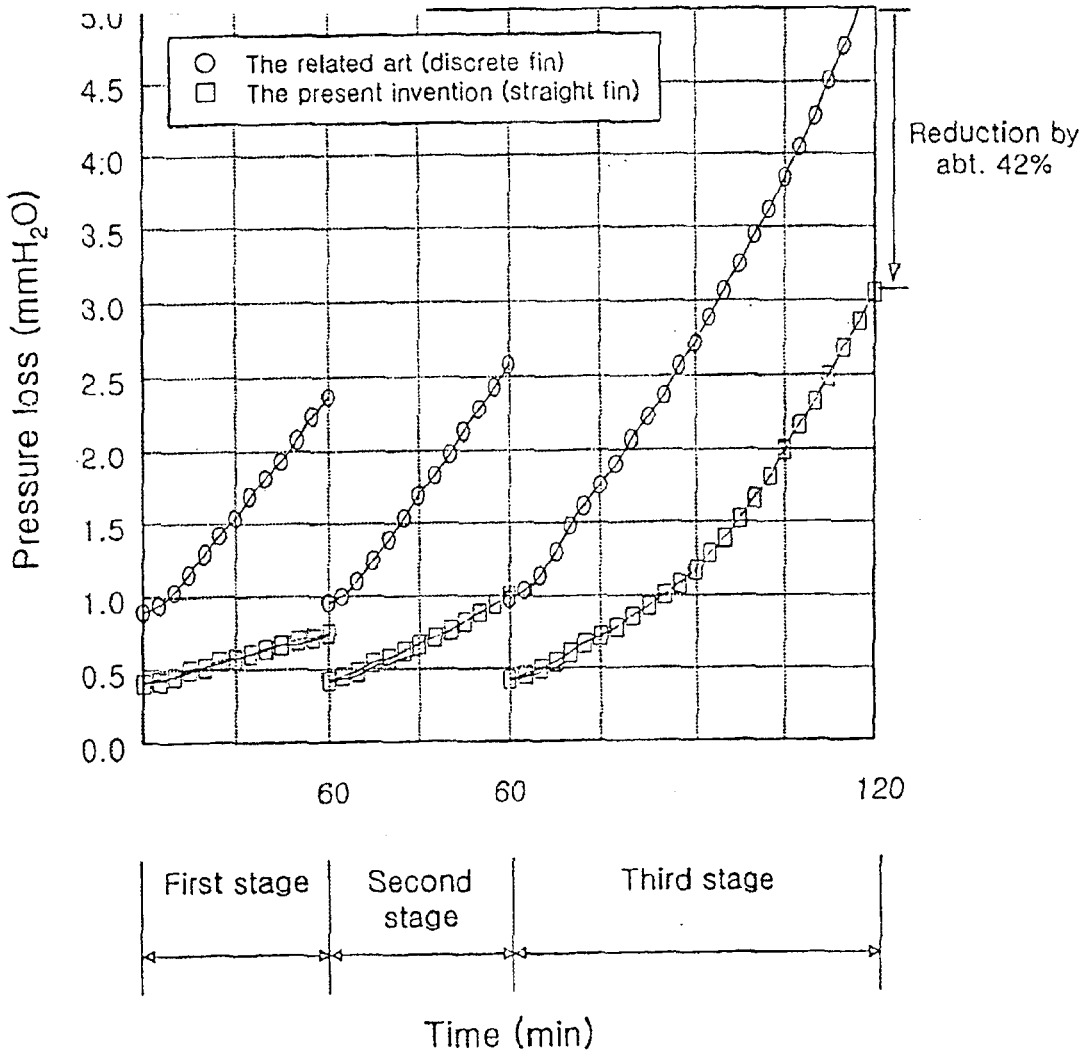

Moreover, such a reduction of remained defrosted water is related to a pressure loss of a heat exchanger directly, which is apparent from FIG. 6 illustrating variation of the pressure loss vs. operation time period. In the test, identical to FIG. 5, heat exchangers having the discrete fins and the straight fins applied thereto are compared, wherein the pressure loss is a pressure difference between an air inlet (bottom of the heat exchanger) and an air outlet (a top of the heat exchanger). In a first stage, variation of a pressure loss is measured during 60 minutes of cooling operation of a dry heat exchanger, and, in a second stage, variation of a pressure is measured during 60 minutes of cooling operation again after a certain time period of defrosting in continuation from the first stage. Finally, in a third stage, variation of a pressure is measured during 120 minutes of cooling operation again after defrosting in continuation from the second stage. It can be noted from FIG. 6 that the pressure loss of the present invention is smaller than the related art in overall, and an increasing ratio of the pressure loss, represented with a slope of the graph, is smaller, too. Actually, the present invention has only approx. 42% of pressure loss of the related art at an end of in each of the stages, because of the small amount of remained defrosted water, along with a reduced formation of frost and reduced increase ratio of the frost, that reduces the flow resistance. Together with this, the no substantial reduction of a heat transfer area during operation coming from the reduced formation of the frost permits no reduction of a heat exchange rate.

Moreover, since the straight fin 20 of the present invention has an effect the discrete fins are arranged in succession, the heat exchanger of the present invention can be formed at a size smaller compared to the heat exchanger of the discrete fins having the same heat transfer area applied thereto. By applying the straight fins 20, the heat exchanger of the present invention has simpler structure, and simpler fabrication process as the straight fin 20 can be coupled with the straight parts of the refrigerant tube on the same column at a time easily in assembly.

In conclusion, by applying the straight fins 20, the heat exchanger of the present invention is favorable compared to the related art heat exchanger having the discrete fins 20 in view of structure and performance.

Figure 7:
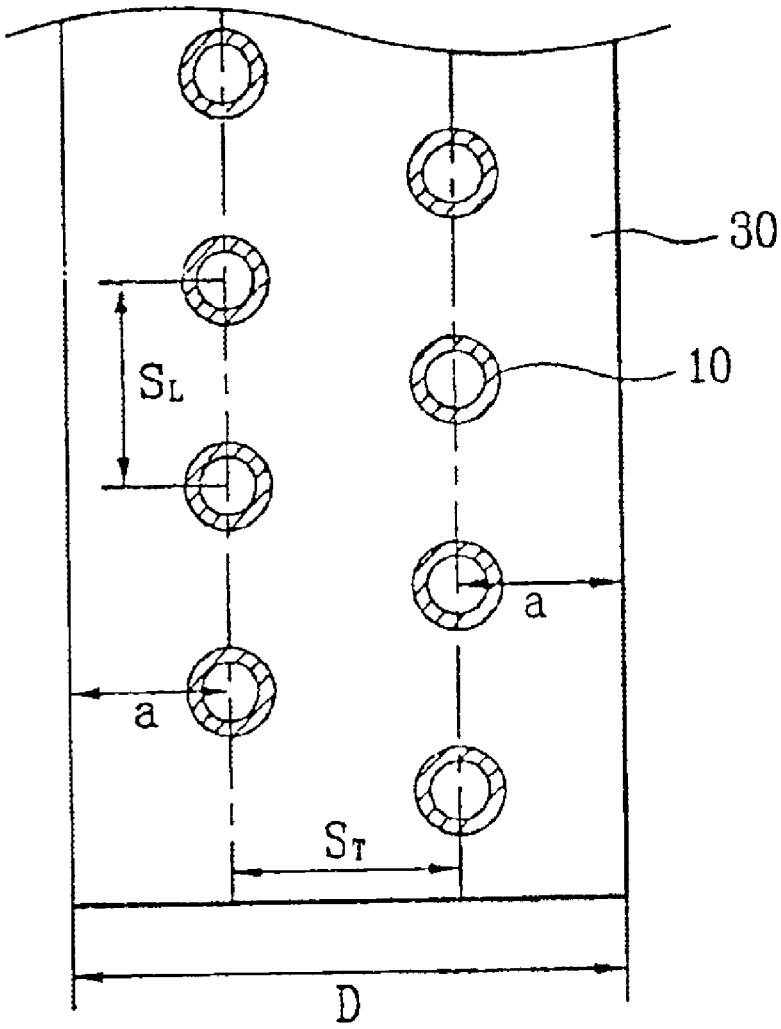

In the meantime, in the heat exchanger of the present invention, the reinforcing plates 30, having a relatively greater thickness, protect the fins 20, and, having a length greater than the fin 20, induce air flow into an inner part of the heat exchanger. The air induced by the reinforcing plates is involved in more resistance in flowing between the refrigerant tubes 10 perpendicular to the reinforcing plates 30 and thicker than the fins 20, more particularly, between the straight parts 11, than in flowing between the fins 20 parallel to the reinforcing plates 20. Thus, an arrangement of the refrigerant is an important factor of a heat exchange performance, for explaining which FIG. 7 illustrates a geometrical relation of the reinforcing plate 30 and the refrigerant tube 10 schematically, where 'D' denotes a width of the reinforcing plate 30, $S_T$ denotes a distance between centers of the refrigerant tube on the same column, and $S_L$ denotes a distance between centers of straight parts 11 of the refrigerant tube on the same column. And, 'a' denotes a distance from a center of the refrigerant tube 10 on an outermost column to a side edge of the reinforcing plate 30.

In the refrigerant tube arrangement, it is required that the distance $S_T$ is set to have appropriate resistance and pressure loss, with reference to the width 'D' of the reinforcing plates 30 that, in fact, corresponds to a width of a flow area perpendicular to respective columns of the refrigerant tubes. Accordingly, it is preferable that the distance $S_T$ is set to meet a relation expressed by the following equation, when 'N' denotes a column number of the refrigerant tube.

$$S_T=D/N$$

Such an optimal distance $S_T$ is verified effective in an actual test, and FIGS. 8A–8C illustrate a test result of the distance $S_T$. In the test, the width D is fixed to be 60 mm, and the distance $S_L$ is fixed to be 30 mm. A heat exchange efficiency and a pressure loss of the fin 20 are measured while the distance $S_T$ is varied for a heat exchanger with two columns (N=2). At first, as shown in FIG. 8A, when $S_T<D/N$ ($S_T$=20 mm, D/N=30 mm), the fin 20 has a 75.1% heat exchange efficiency, and a pressure loss of 1.566 $mmH_2O$, as shown in FIG. 8B, when $S_T=D/N$ ($S_T$=30 mm, D/N=30 mm), the fin 20 has a 81.4% heat exchange efficiency, and a pressure loss of 0.686 $mmH_2O$, and as shown in FIG. 8C, when $S_T>D/N$ ($S_T$=40 mm, D/N=30 mm), the fin 20 has a 75.1% heat exchange efficiency, and a pressure loss of 0.562 $mmH_2O$. The test results are compared, to find that, though the pressure loss keeps decreasing (i.e., an air flow rate keeps increasing) as the distance $S_T$ keeps increasing, the heat exchange efficiency decreases after the distance $S_T$=30 mm ($S_T$=D/N) on the contrary. In general, though a performance of a heat exchanger is dependent on heat exchange efficiencies of the fin, and the like, and an air flow rate discharge after the heat exchange, as can be noted in the foregoing test results, those show an opposite relation in a range outside of a certain range. That is, though the heat exchange efficiency increases as a heat exchange area between the refrigerating tube 10/fin 20 and a heat exchange time period increase, it causes an increased pressure loss that reduces the heat exchange discharge flow rate by increasing the flow resistance. Opposite to this, even if the pressure loss is reduced by reducing the flow resistance, there is a possibility of a heat exchange efficiency decrease. Therefore, taking the relation into account, since the heat exchange efficiency and the pressure loss have appropriate threshold values at $S_T$=30 mm respectively, it can be known that the $S_T$ is optimal when $S_T$=D/N. This tendency is the same even if a number 'N' of the columns increases (N=3, 4, or 5), or other dimension D, or $S_L$ is changed.

Moreover, it is required that an adequate flow space is secured between a side edge of each of the reinforcing plates 30 and an outermost refrigerating tube column for preventing the air flow breaks away to outside of the heat exchanger from the refrigerating tube 10 on each of the outermost columns. For this, it is preferable that the distance 'a' is $S_T/2$.

Lastly, the distance $S_L$ can be obtained from test results shown in FIGS. 9A–9C with reference to the distance $S_T$. In the tests, the width D, and the distance $S_T$ are fixed to be 60 mm, and 30 mm to meet $S_T$=D/N respectively, and an actual heat exchange rate is measured while the distance $S_L$ is varied for a heat exchanger with two columns (N=2) of refrigerating tubes 10. At first, as shown in FIG. 9A, when the distance $S_L$=20 mm, the heat exchange rate at the fin 20 is measured to be 548.9 kcal/h. As shown in FIG. 9B, when the distance $S_L$=30 mm, the heat exchange rate is 564.2 kcal/h, and as shown in FIG. 9C, when the distance $S_L$=40 mm, the heat exchange rate is 554.1 kcal/h. It is measured that all the cases have almost identical pressure reduction values. As can be noted from the test results, the greatest heat exchange value can be obtained at $S_L$=30 mm. Accordingly, it is the most appropriate that $S_T/S_L$=1, i.e., the distance $S_T$ is set to be the same with the distance $S_L$.

Thus, as explained, the set respective distances $S_T$, $S_L$, and 'a' optimize arrangement of the refrigerating tube 10 in the heat exchanger of the present invention.

It will be apparent to those skilled in the art that various modifications and variations can be made in a heat exchanger for refrigerator of the present invention without departing from the spirit or scope of the invention. Thus, it is intended that the present invention cover the modifications and variations of this invention provided they come within the scope of the appended claims and their equivalents.

INDUSTRIAL APPLICABILITY

In the present invention, the employment of continuous straight fins basically improves the defrosted water discharge performance actually, and suppresses formation of the frost basically. And, distances between refrigerating tube lines and distances between straight parts of the refrigerating tube on the same column are optimized. Accordingly, in the present invention, the pressure loss is reduced (discharge flow rate increases), the heat exchange efficiency increases, and the heat exchanger performance is improved, accordingly.

The simple structured fin of the present invention in comparison to the discrete fin of the related art permits an easy assembly of the heat exchanger. Along with this, the employment of the straight fin simplifies a defroster structure, too. That is, the heat exchanger of the present invention has fewer number of components compared to the related art structure, a low cost, and an improved productivity since no separate machining and assembly steps are required.

The employment of the straight fin permits to implement the same heat exchange performance at a small size. Along with those features, the aforementioned heat exchange performance improvement and the simple structure optimize the heat exchanger of the present invention to be suitable to the refrigerator.

What is claimed is:

1. A heat exchanger for a refrigerator comprising:

one, or more than one perpendicular columns of refrigerating tubes each including a plurality of straight parts, and a plurality of curved parts connecting the straight parts;

a plurality of straight plate type fins each having a plurality of through holes formed therein on one or more than one column along a length direction for coupling with the straight parts of the refrigerating tubes; and one pair of reinforcing plates coupled with the straight parts of the refrigerating tube at opposite sides of the fins, wherein $S_T$=D/N, where 'D' denotes a width of the reinforcing plate, $S_T$ denotes a distance between centers of the refrigerant tube on the same column, and N denotes a number of columns of the refrigerating tube.

2. A heat exchanger as claimed in claim 1, wherein a=$S_T$/2, where 'a' denotes a distance from a center of the refrigerant tube on an outermost column to a side edge of the reinforcing plate.

3. A heat exchanger as claimed in claim 1, wherein $S_T/S_L$=1, where $S_L$ denotes a distance between centers of straight parts of the refrigerant tube on the same column.

* * * * *